US006196045B1

(12) United States Patent
Thomas et al.

(10) Patent No.: US 6,196,045 B1
(45) Date of Patent: Mar. 6, 2001

(54) POWERED CRIMPING TOOL

(75) Inventors: Glenn E. Thomas, Louisville; Paul T. Scherer, Lexington; Joseph L. Hallock, Lexington; Edward B. Alcorn, Lexington, all of KY (US)

(73) Assignee: Chromatography Research Supplies, Inc., Louisville, KY (US)

( * ) Notice: Subject to any disclaimer, the term of this patent is extended or adjusted under 35 U.S.C. 154(b) by 0 days.

(21) Appl. No.: 09/468,031

(22) Filed: Dec. 20, 1999

(51) Int. Cl.[7] ..... B21D 7/00; B65B 7/28

(52) U.S. Cl. ..... 72/454; 72/453.16; 72/416; 72/409.19; 29/751

(58) Field of Search ..... 72/454, 453.15, 72/453.16, 416, 409.01, 409.14, 409.19; 29/751

(56) References Cited

U.S. PATENT DOCUMENTS

| | | | | |
|---|---|---|---|---|
| 1,067,797 | | 7/1913 | Chellis . | |
| 1,834,208 | | 12/1931 | Hall . | |
| 2,415,896 | | 2/1947 | Marsh et al. | 81/15 |
| 2,811,001 | | 10/1957 | Nyberg | 53/329 |
| 2,829,549 | * | 4/1958 | Demler | 72/751 |
| 3,158,879 | | 12/1964 | Barrett | 7/14.6 |
| 3,162,002 | | 12/1964 | Brear | 53/363 |
| 3,217,519 | | 11/1965 | Demler | 72/15 |
| 3,328,871 | * | 7/1967 | Over | 72/751 |
| 3,332,211 | | 7/1967 | Koll et al. | 53/353 |
| 3,420,086 | * | 1/1969 | Long et al. | 72/751 |
| 3,747,441 | | 7/1973 | Amtsberg et al. | 81/10 |
| 3,771,284 | | 11/1973 | Boeckmann et al. | 53/282 |
| 3,998,032 | | 12/1976 | Koebbeman | 53/351 |
| 4,226,109 | * | 10/1980 | Nilsson | 72/453.15 |
| 4,292,833 | * | 10/1981 | Lapp | 72/453.16 |
| 4,589,271 | * | 5/1986 | Laux | 72/416 |
| 4,745,729 | | 5/1988 | Bethge et al. | 53/331.5 |
| 4,987,722 | | 1/1991 | Koebbeman | 53/353 |
| 5,327,697 | | 7/1994 | Kent | 53/331.5 |
| 5,579,626 | | 12/1996 | Thomas | 53/331.5 |
| 6,076,330 | * | 6/2000 | Thomas et al. | 72/454 |

FOREIGN PATENT DOCUMENTS 776080 6/1957 (GB) .

* cited by examiner

*Primary Examiner*—David Jones
(74) *Attorney, Agent, or Firm*—James C. Eaves, Jr.; Greenebaum Doll & McDonald PLLC

(57) ABSTRACT

The present invention relates to a powered crimping tool. In the parent application, referenced above, the tool, having a plurality of crimping jaws, is used to secure a cap onto a bottle or vial. In this application, the tool, having a pair of opposed crimping heads, is used to crimp a solderless terminal, splice, butt connector, or the like, having a wire inserted into a shaft and to be retained therein. The powered tool has a housing portion which the user holds and includes switches for the user to control the plunger and the crimping action. Selected mating crimper heads in the plunger and the crimper housing effectuate the crimping of the selected terminal to retain the wire therein. These mating crimper heads can be changed to accommodate a variety of different size and shape terminals, splices, butt connectors, wires, and the like. Terminals may be insulated or not. Wires may be stranded or solid.

17 Claims, 17 Drawing Sheets

POWERED CRIMPING TOOL

This application is a continuation-in-part of application U.S. Ser. No. 09/243,301, filed Feb. 2, 1999, for a powered crimping tool to secure a cap onto a bottle or vial, incorporated herein by reference.

BACKGROUND OF THE INVENTION (a) Field of the Invention

The present invention relates to a powered crimping tool. In the parent application, referenced above, the tool, having a plurality of crimping jaws, is used to secure a cap onto a bottle or vial. In this application, the tool, having a pair of opposed crimping heads, is used to crimp a solderless terminal, splice, butt connector, or the like, having a wire inserted into a shaft and to be retained therein. The powered tool has a housing portion which the user holds and includes switches for the user to control the plunger and the crimping action. Selected mating crimper heads in the plunger and the crimper housing effectuate the crimping of the selected terminal to retain the wire therein. These mating crimper heads can be changed to accommodate a variety of different size and shape terminals, splices, butt connectors, wires, and the like. Terminals may be insulated or not. Wires may be stranded or solid.

(b) Description of the Prior Art

In the parent application, various crimping tools are taught related to crimping a cap onto a bottle or vial. U.S. Pat. No. 5,579,626, to Applicant Thomas, which teaches a manually operated crimping tool for securing a cap onto a bottle or vial. U.S. Pat. No. 4,987,722, to Koebbeman, teaches a hand-held bottle cap crimper having a pair of horizontal crimping handles, one upper fixed handle and one lower lever handle which moves about a single pivot point to move a crimper, the pivot point being between jaws and the handles so that the tool functions in a see saw fashion. U.S. Pat. No. 4,745,729 to Bethge et al., teaches a container closing apparatus used to put on a screw cap. U.S. Pat. No. 3,998,032, to Koebbeman, teaches a hand-held bottle cap crimper having a pair of horizontal crimping handles, one lower fixed handle and one upper lever handle which moves about a single pivot point to move a crimper, the jaws being between the pivot-point and the handles. U.S. Pat. No. 3,332,211, to Koll et al., teaches a cap applying apparatus. U.S. Pat. No. 3,217,519, to Demler, teaches a coaxial crimping tool. U.S. Pat. No. 2,415,896, to Marsh et al., a cap applying implement. U.S. Pat. No. 5,327,697, to Kent, teaches a chuck for a bottle capper. U.S. Pat. No. 3,771,284, to Boeckmann et al., teaches a capping apparatus. Finally, U.S. Pat. No. 3,747,441, to Amtsberg et al., teaches a pneumatic tool having combined nut running and crimping mechanism.

Solderless terminals have a shaft where a wire is to be received. The terminals may have any type head thereon, for example, loops or rings, hooks, prongs, or spades. The terminals may be insulated or not. The terminal heads have differing sizes, for example, to fit a variety of screw sizes. The shaft normally has a wire receiving opening which is surrounded by the shaft. The shatf typically has a lengthwise split therein which permits the shaft to be crimped down onto the wire inserted therein. Butt connectors, splices, and quick disconnect terminals are similarly configured. Historically, a manually operated ratchet crimping tool is used to crimp the terminal shaft to secure the wire therein.

SUMMARY OF THE INVENTION

The present invention relates to a powered crimping tool. In the parent application, the tool is used to secure a cap onto a bottle or vial. In the instant application, the tool is used to crimp the shaft of a terminal, splice, disconnect, or the like to retain a wire therein. The types of terminals, splices, and the like to be crimped were described above. In crimping wires within these items, this wire crimping tool has several advantages. First, hand fatigue is reduced with the powered crimper. Second, the powered tool can hold the terminal securely prior to crimping without compressing the terminal and making the wire more difficult to insert into the item shaft, a problem frequently encountered when operating a manual crimper. Third, the actual crimp can be the same every time, in contrast to manual crimping tools where the operator's hand pressure determines the crimp. With manual tools, an undercrimp resulting in a loose wire and bad electrical connection or an overcrimp resulting in terminal or wire damage can occur. This precise crimp permits use with exotic terminals, such as insulation piercing terminals, which are applied without stripping the insulation or covering from the wire, and require precise crimping to work properly.

The powered wire crimping tool has a vertical housing portion which the user holds while activating the crimping action. The crimping action results from a motor causing a plunger having a crimper head contained therein to move downward toward an opposed crimper head. When the crimper heads engage the shaft of the terminal, splice, disconnect, or the like, which is to have a wire crimped therein, the wire can be inserted into the shaft. Then the crimper can be further engaged to crimp the shaft onto the wire. While the crimper can simply be operated by turning on and off the motor, preferably means can be provided to adjust the finishing point of the crimping cycle or the plunger lower limit, as well as a pause point where the crimper heads engage the shaft prior to crimping, to permit insertion of the wire into the shaft. While means can also be provided to vary the starting point of the crimping cycle or the plunger upper limit, it is envisioned that by carefully sizing the geometry of the first and second crimper heads, a uniform starting point will suffice. If desired, as the terminal, splice, disconnect, or the like, are of various sizes, a variety of upper limits, pause points, and/or lower limits can be programmed with the user being able to select those desired for the terminal, splice, disconnect, or the like, the wire, and the crimping heads selected.

More particularly, the present invention comprises a housing containing a battery-operated motor. A speed reduction system having a ratio of about 64 to 1 causes a plunger lead screw to rotate at a speed of about 1/64th the motor speed. The plunger lead screw has a threaded drive shaft which is threadably received within the plunger threaded drive channel. Rotation of the plunger lead screw threaded drive shaft results in vertical movement of the plunger, as limited by the hex shaped plunger's vertical travel within the hex shaped plunger receiving opening in the crimper housing. Other forms of keying can be used. For example, in cross-section, a triangular, square, or other shaped plunger/plunger receiving opening could be used, so long as the plunger can not rotate within the plunger receiving opening. In fact, the plunger and opening do not have to have the same cross-section shape. For example, a plunger with triangular cross-section would fit inside a plunger receiving opening with hex cross-section.

The total movement of plunger from the upper to lower limit and back to the upper limit is controlled. Further, if desired, the crimping tool can include a control so that once the plunger has moved through a pre-set vertical distance, the plunger will complete one crimping cycle without the user having to continue to engage a control. This frees the user to concentrate on the crimping operation. For example, the control can require the activating button to be held down until the pause position has been reached. Then, simply pressing the activating button again will cause the plunger to complete the crimping cycle to the lower limit and return to the upper limit. For this period, the activating button does not have to be further engaged by the user.

Finally, the present invention comprises a powered crimping tool, having a housing containing a motor therein, the housing receiving a crimper housing having an opening therein, the crimper housing having a lower crimper head receiving member having a lower crimper head opening therein; a plunger received by the crimper housing opening, the plunger having an upper crimper head opening therein; an upper crimper head received by the upper crimper head opening and a lower crimper head received by the lower crimper head opening; the plunger being movable by the motor so as to move the upper crimper head toward the lower crimper head to crimp an item and to move the upper crimper head away from the lower crimper head to remove the item crimped.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
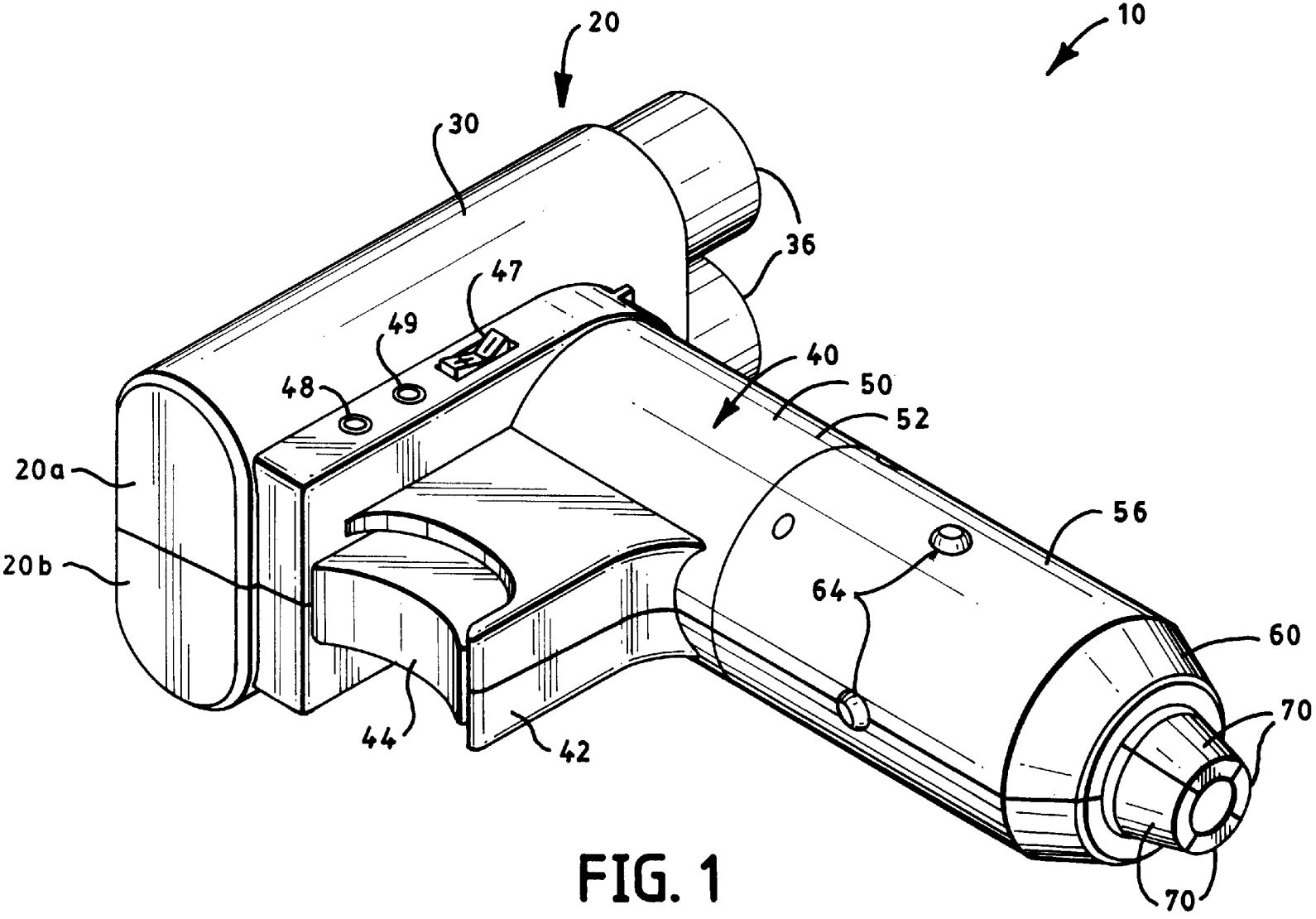
FIG. 1 shows a first perspective view of the tool of the present invention.

With reference to FIGS. 1–9, the tool 10 of the instant invention is shown having a housing 20; a motor 90 which drives a plunger lead screw 110, through a speed or gear reduction system 95, the plunger lead screw 110 interfacing a plunger 130; four jaws 70 circumscribing plunger 130 and retained by circular spring 86. Tool 10 also contains electronics which permit the plunger 130 starting point to be adjusted and also permit the crimping cycle to be adjusted.

Figure 2:
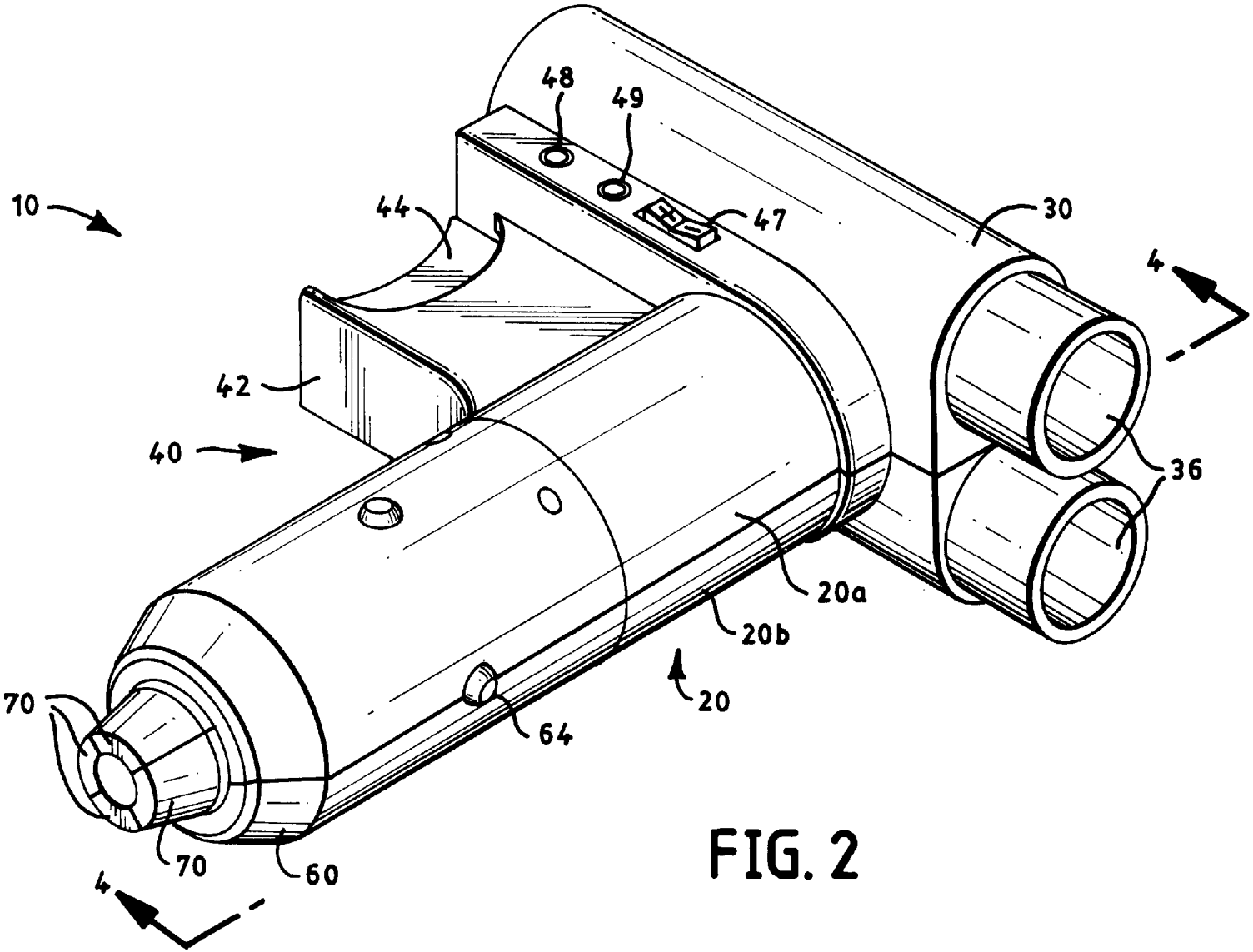
FIG. 2 shows a second perspective view of the tool of FIG. 1, the tool being rotated about 90° clockwise from the view of FIG. 1.

FIGS. 1 and 2 show the tool 10 having a split housing 20 having parts 20*a* and 20*b*. Housing 20 comprises an upper housing portion 30 and a lower housing portion 40. Lower housing portion 40 is the "grip" portion and will be held in a vertical orientation by a user when using the crimper. From portion 30 to jaws 70, portion 40 contains a trigger portion 42 and a vertically elongated chamber portion 50 adjacent portion 30. Adjacent chamber portion 50 is a middle plunger/gear receiving portion 56. Finally, there is a lower jaw receiving portion 60.

Figure 3:
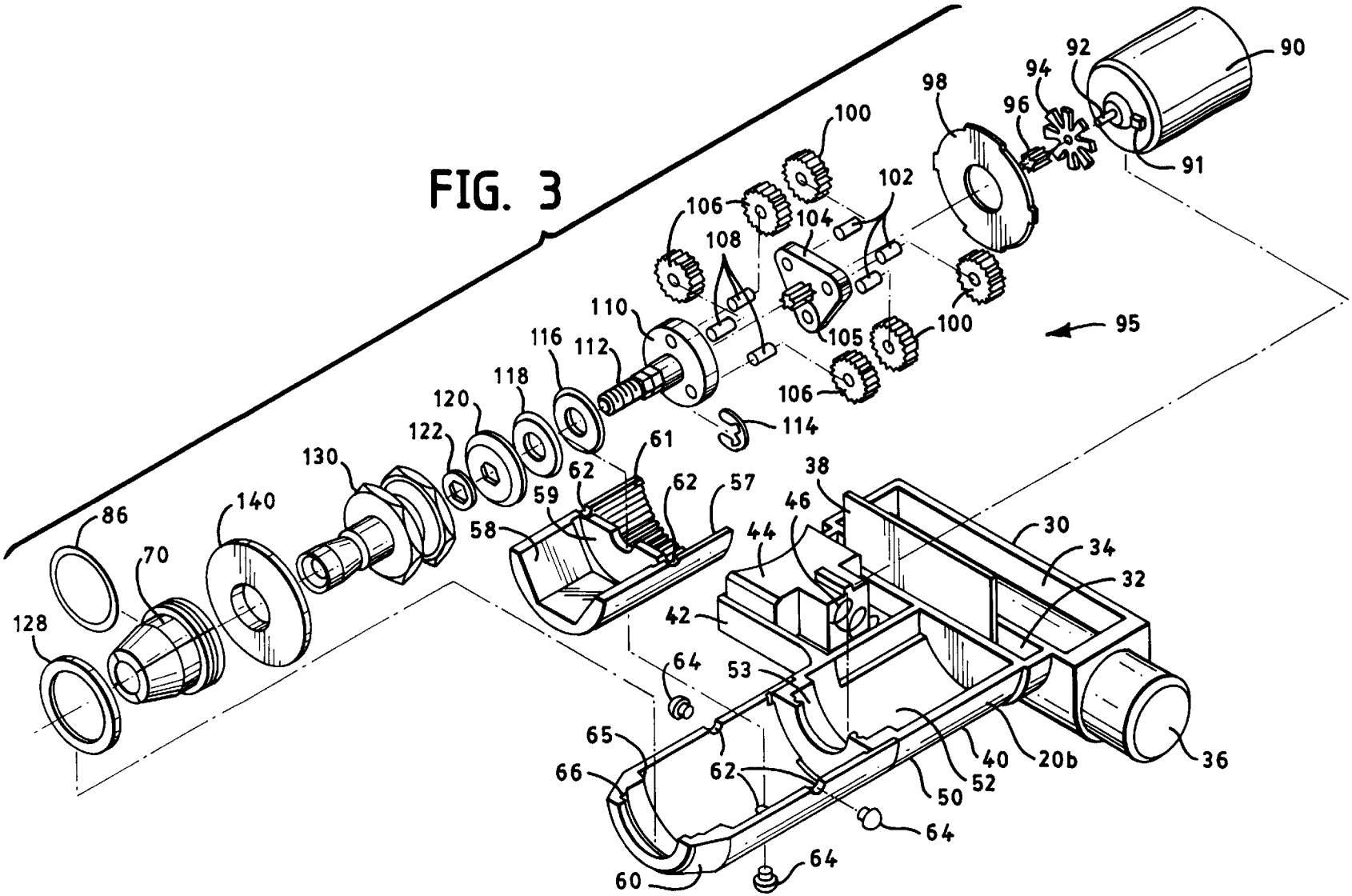
FIG. 3 shows an exploded view of the tool of FIGS. 1 and 2 with a portion of the housing and insert removed to show how the housing receives the various components.

With reference to FIGS. 1–3, upper housing portion 30 includes a horizontal elongated chamber 32 which contains circuit board 38. The operation of the electronics is explained later with reference to FIG. 10. However, the circuit board 38 is operationally connected to the power source, shown as a pair of 3.6 volt batteries 36, motor 90, pulse sensor or encoder 91, trigger 44, rocker switch 47, and LED 48. One or more batteries can be used to power the tool 10 and are received in battery receiving channels 34. If multiple batteries are used, they can be in parallel to provided more crimps per charge or in series to provide more power. Naturally, they will be matched to the motor requirements. As shown, a pair of batteries 36 provide 3.6 volts DC. Also, external power sources can be used to power the tool 10. On the outside of chamber 32 are rocker switch 47 and LED 1548, the operation of which is explained with the description of the electronics with FIG. 10.

Trigger portion 42 includes a trigger 44 and a trigger spring 46. The trigger 44 is used to activate the crimping cycle and the spring 46 is used to deactivate the trigger 44. Any comparable activation means can be employed in place of the trigger system. For example, a simple push button could be used which makes a simple contact when pressed to activate the crimp cycle. This push button could be anywhere on housing 20 and would replace the entire trigger portion 42. So, instead of holding a trigger grip, the user would grip the cylindrical lower housing 40. For ergonomic design, the external shape of lower housing portion 40 could altered from cylindrical without operational effect.

Figure 4:
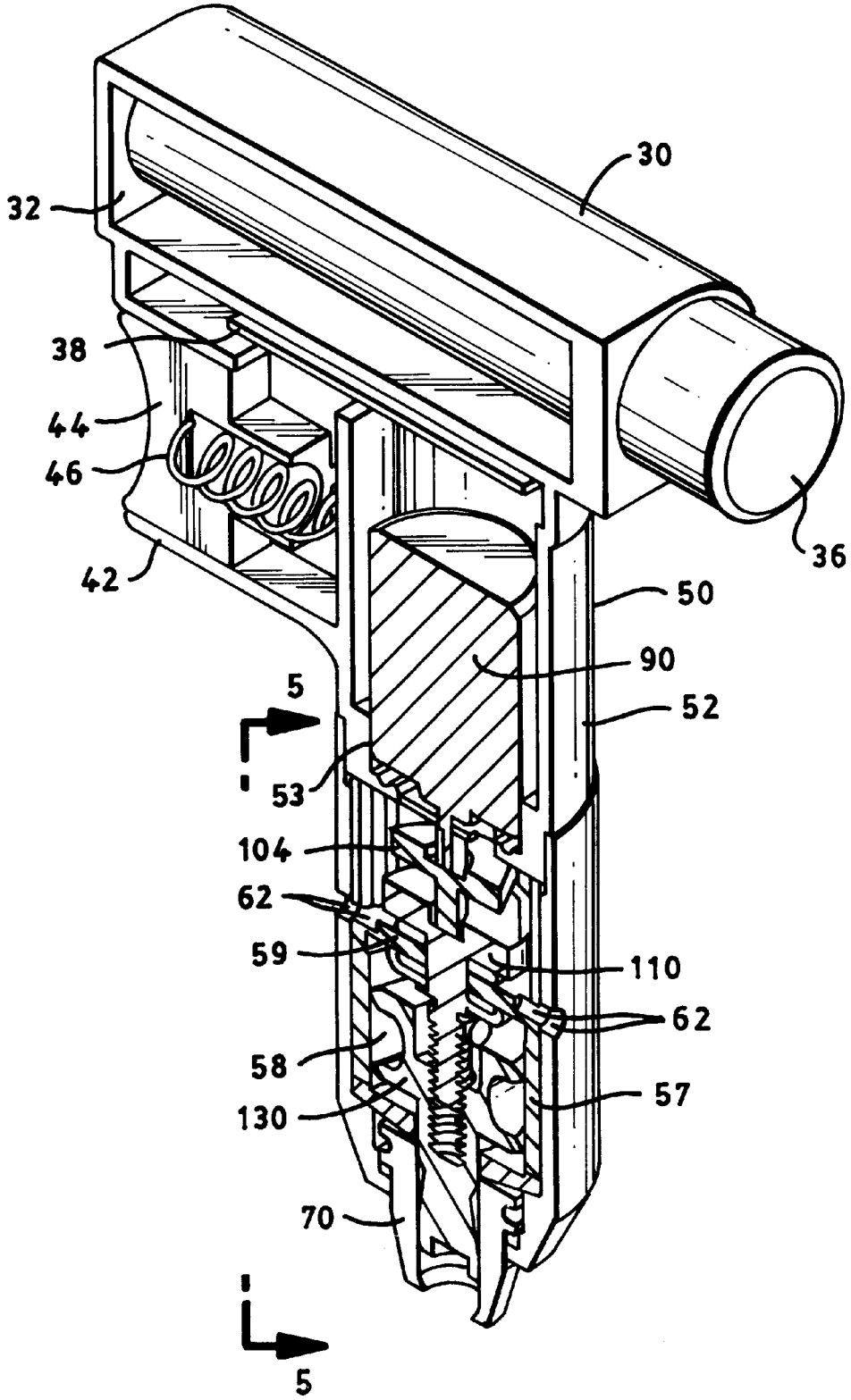
FIG. 4 shows a cross-sectional view of the tool of FIGS. 1 and 2 along the lines 4—4 of FIG. 2.
Figure 5:
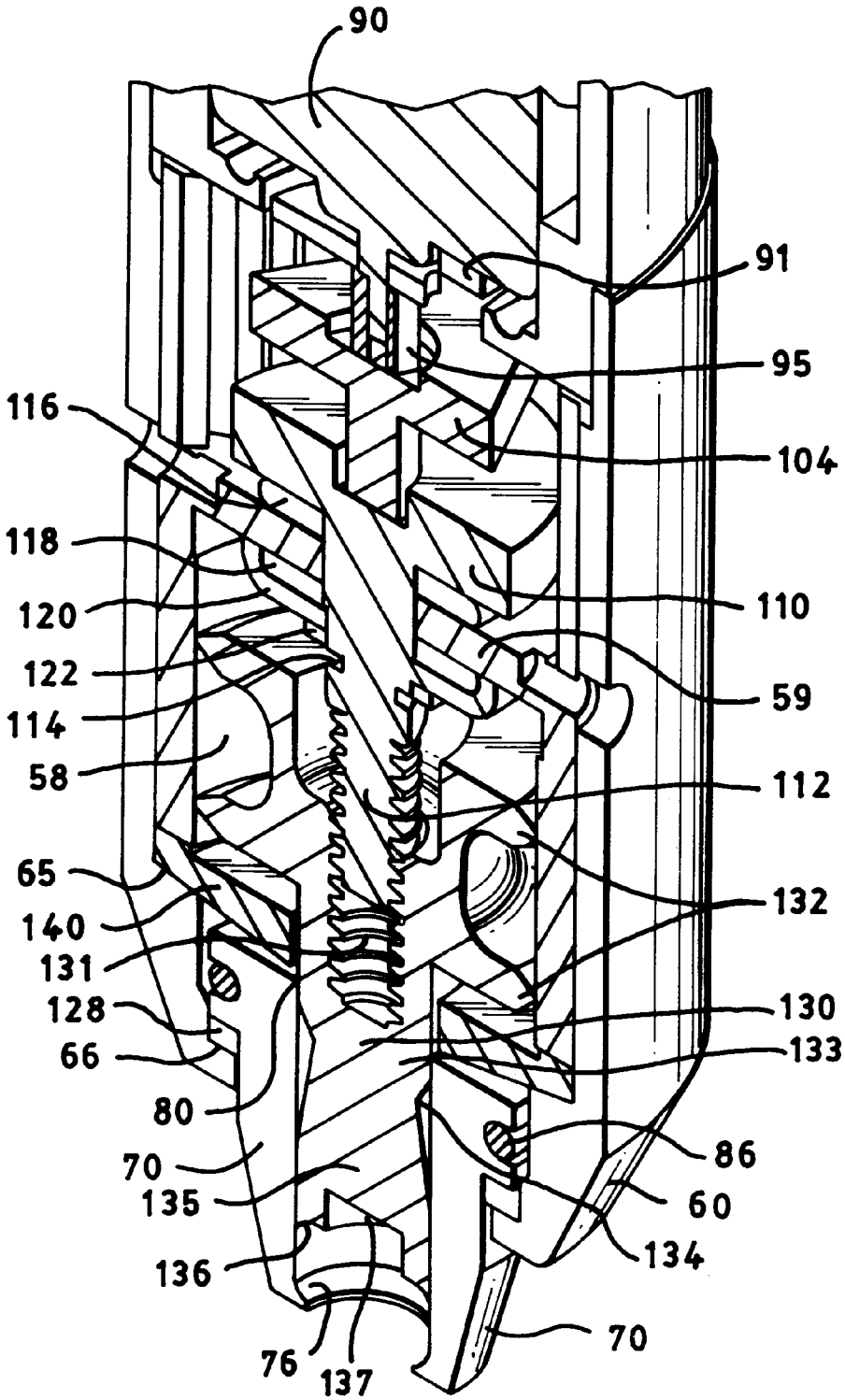
FIG. 5 shows an enlarged lower portion of the cross sectional view of FIG. 4 along the lines 5—5 of FIG. 4.
Figure 6:
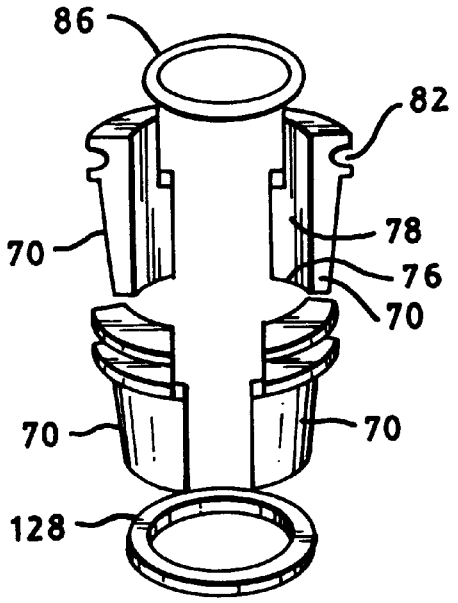
FIG. 6 shows an exploded perspective view of the jaws, circular spring, and steel bushing of the tool of the present invention.

With particular reference to FIGS. 3–5, the internal connectivity of the components is described. Chamber 50 contains an internal upper motor receiving portion 52 with a motor seat 53 at its lower portion. FIGS. 4 and 5 show how motor 90 is received within portion 52 and seat 53. Motor 90 is a typical DC 24 pole motor found in battery operated power tools, such as a Black & Decker model VP720 powered screwdriver. Without load, the motor powered shaft 92 rotates at about 5760 rpm. Attached to shaft 92 are a pulse disk 94 and a shaft gear 96. Pulse disk 94 provides for 8 pulses for every 3600 rotation of shaft 92. Disk 94's cooperation with pulse sensor 91 and the tool's electronics are explained later.

A wear plate 98 is received on the lower side of motor seat 2053 in middle portion 56. Adjacent the wear plate 98 is a unitary injection molded insert 57, a portion of which is shown in FIG. 3. Insert 57 and chamber 50 contain a plurality of aligned bores 62 therein which receive screws or bolts 64 therein to attach insert 57 in its desired location within chamber 50. Insert 57 contains a hex plunger channel 58 on its lower end and a gear channel 61 on its upper end, with a retaining member 59 with an opening therethrough in between 58/61. Gear channel 61 receives the speed or gear reduction system 95 therein.

Speed or gear reduction system 95 contains a pair of 8 to 1 speed reduction assemblies which first reduce the motor revolutions from approximately 5760 rpm to approximately 720 rpm and then to approximately 90 rpm. Three first gears 100 are received on shafts 102 attached to the upper side of a rotor 104. Motor shaft gear 96 is received within and engages the three first gears 100. The interior circumference of gear channel 61 is channeled to match the gearing of gears 100. With shaft gear 1596 rotating at 5760 rpm, gears 100 rotate around shafts 102 and translate within gear channel 61 thereby causing the rotor 104 and gear shaft 105 on the lower side of rotor 104 to rotate at 720 rpm.

Three second gears 106 are received on shafts 108 attached to the upper side of plunger lead screw 110. Rotor shaft gear 105 is received within and engages the three second gears 106. With gear shaft 105 rotating at 720 rpm, gears 106 rotate around shafts 108 and translate within gear channel 61 thereby causing the plunger lead screw and the plunger threaded drive shaft 112 extending downward therefrom to rotate at 90 rpm. This results in a 64 to 1 reduction of motor 90 rotational speed in two 8 to 1 reduction stages. Similar speed reduction systems in more or less stages can be employed to achieve the desired rotational speed of the plunger lead screw 110. Also, under load, the rotational speeds will generally be less.

The plunger threaded drive shaft 112 receives an upper thrust bearing 116 thereover and then the shaft 112 is received through the opening in the insert 57 retaining member 59, extending into the hex plunger channel 58. On the under side of the member 59, shaft 112 sequentially receives a lower thrust bearing 118, a bearing housing 120, a retaining washer 122 and a retaining clip 114. The thrust bearings 116 and 118 help to minimize the torque requirements, the bottom thrust bearing 118 being leaded when the plunger 130 is moving downward and the upper thrust bearing 116 being loaded when the plunger 130 is moving upward.

Threaded drive shaft 112 is threadably received within plunger 130's threaded drive channel 131. Plunger hex guide member 132 and hex plunger channel 58 cooperate to prevent rotation of the plunger 130, but permit movement toward or away from the member 59. It is the rotation of plunger lead screw 110's threaded drive shaft-112 within plunger drive channel 131 and the cooperation of hex channel 58 and plunger hex guide member 132 which cause the circular rotation of motor 90's shaft 92 to be translated into a vertical movement of the plunger 130.

At the lower end of chamber 50 is a stop washer ridge 65 which has a stop washer 140 adjacent it's upper side. The lower side of stop washer 140 starts the lower jaw receiving portion 60 of the lower housing portion 40. At the lower portion of portion 60 is a steel bushing ridge 66 which has a steel bushing 128 adjacent it's upper side. Between stop washer 140 and steel bushing 128 are a plurality of crimping jaws 70. The upper part of jaws 70 abut stop washer 140. The lower part of jaws 70 extend downward through an opening in steel bushing 128. For the preferred embodiment, four jaws 70 are used, although other numbers can be employed within the scope of the invention. The lower portion of the plunger 130 is received within the central circular opening through the jaws 70.

Figure 7:
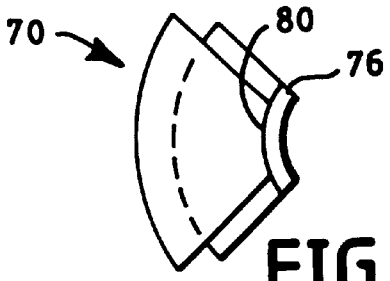
FIG. 7 shows a top view of the jaw of FIG. 8 along the lines 7—7.
Figure 8:
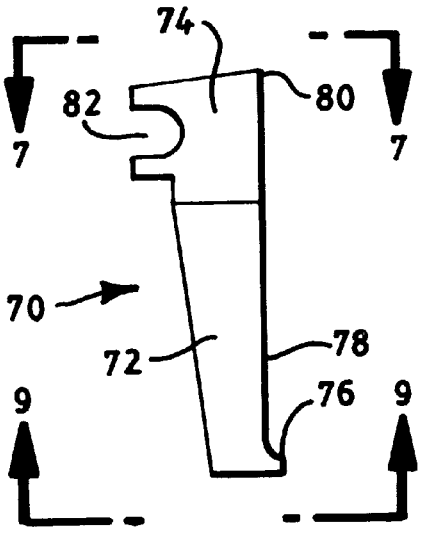
FIG. 8 shows a side view of one of the four jaws of the tool of the present invention.
Figure 9:
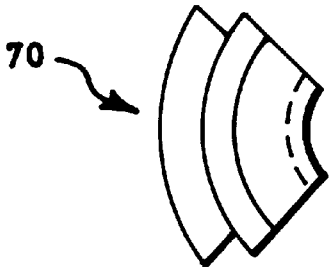
FIG. 9 shows a bottom view of the jaw of FIG. 8 along the lines 9—9.

FIGS. 3–6 show that four jaws 70 are retained on plunger 130 by circular spring 86. Other means, such as an elastic or rubber band can be employed. FIGS. 7–9 show one of the jaws 70. Jaw 70 includes a lower crimping portion 72 and an upper opening portion 74. Portion 72 includes a curved crimping lip 76. The inside curved surface of jaw 70 has a plunger slide area 78 shaped such that when the four jaws 70 are placed together the areas 78 are generally cylindrical shaped with a diameter which approximates that of plunger 130. An engagement point for opening 80 permits jaws 70 to open when received by plunger 130's jaw opening portion 134. A generally horizontal groove 82 is provided to receive circular spring 86.

With particular reference to FIG. 5, the plunger 130 also includes a jaw crimping slide portion 133, the jaw opening portion 134, a cap engaging head 135, a curved surface 136 for centering the cap, and a flat surface 137 to engage the cap top. It is seen that the jaw opening portion 134 has an hour glass shape. In FIG. 5, the jaws 70 are closed, as the plunger 130 has moved downward beyond the cap open position. It can be seen that, if the plunger 130 was moved upward, the jaw opening engagement point 80 will align with the start of the inward slope of jaw opening portion 134. As the plunger 130 continues to move upward, the circular spring 86 in groove 82 causes point 80 to follow the inward slope, thereby causing the jaws 70 to spread apart at the bottom or open so that they can be placed over a bottle or vial for the crimping of a cap thereon. The jaws 70 would be the most open when point 80 is at the smallest diameter part of the hour glass of jaw opening portion 134. As is explained hereinafter, this would generally be the starting point for the crimping cycle. However, if working in confined places, the tool user may not want the jaws to open to this widest opening. Therefore, the starting point can be adjusted by movement of the piston downward to slightly close the jaws 70. For example, the hour glass portion of portion 134 toward portion 133 slopes inward at about 200 from vertical. The cooperation of the plunger 130 and the curved crimping lip 76 cause a cap to be crimped onto a vial or bottle. As explained hereinafter, this cooperation can be adjusted by controlling the stop point of the downward movement of the plunger 130.

Figure 10:
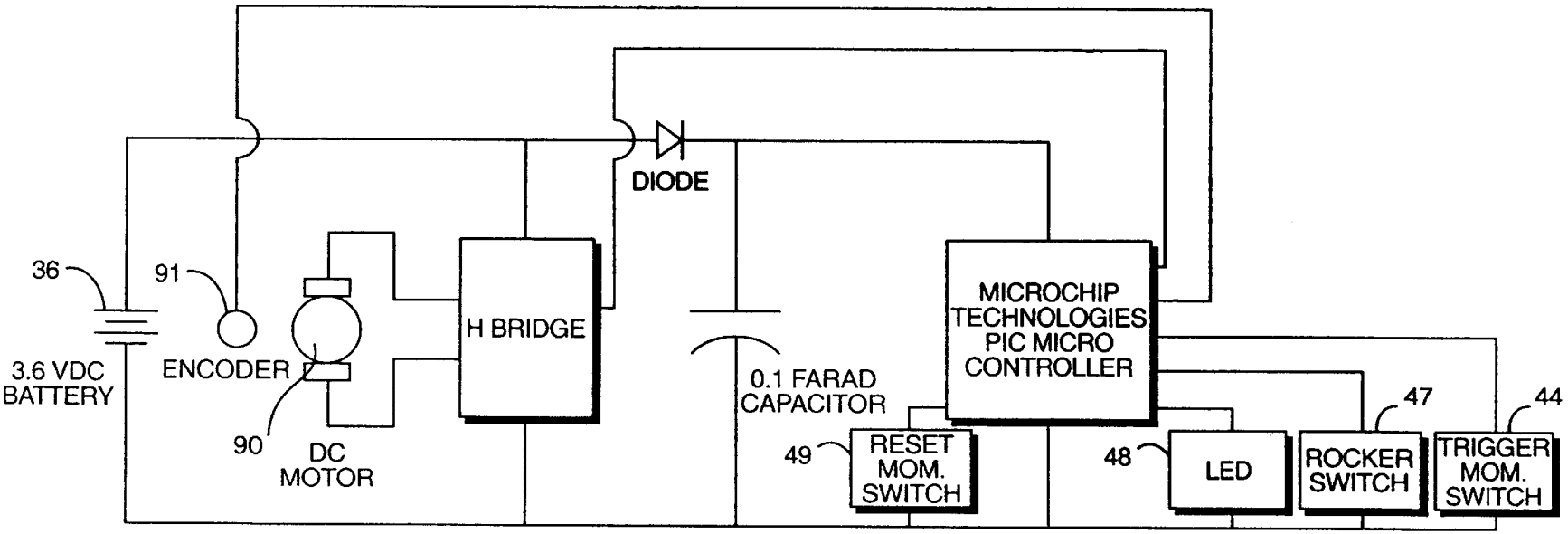
FIG. 10 is a block diagram of the electronic controls of the present invention.
Figure 11A:
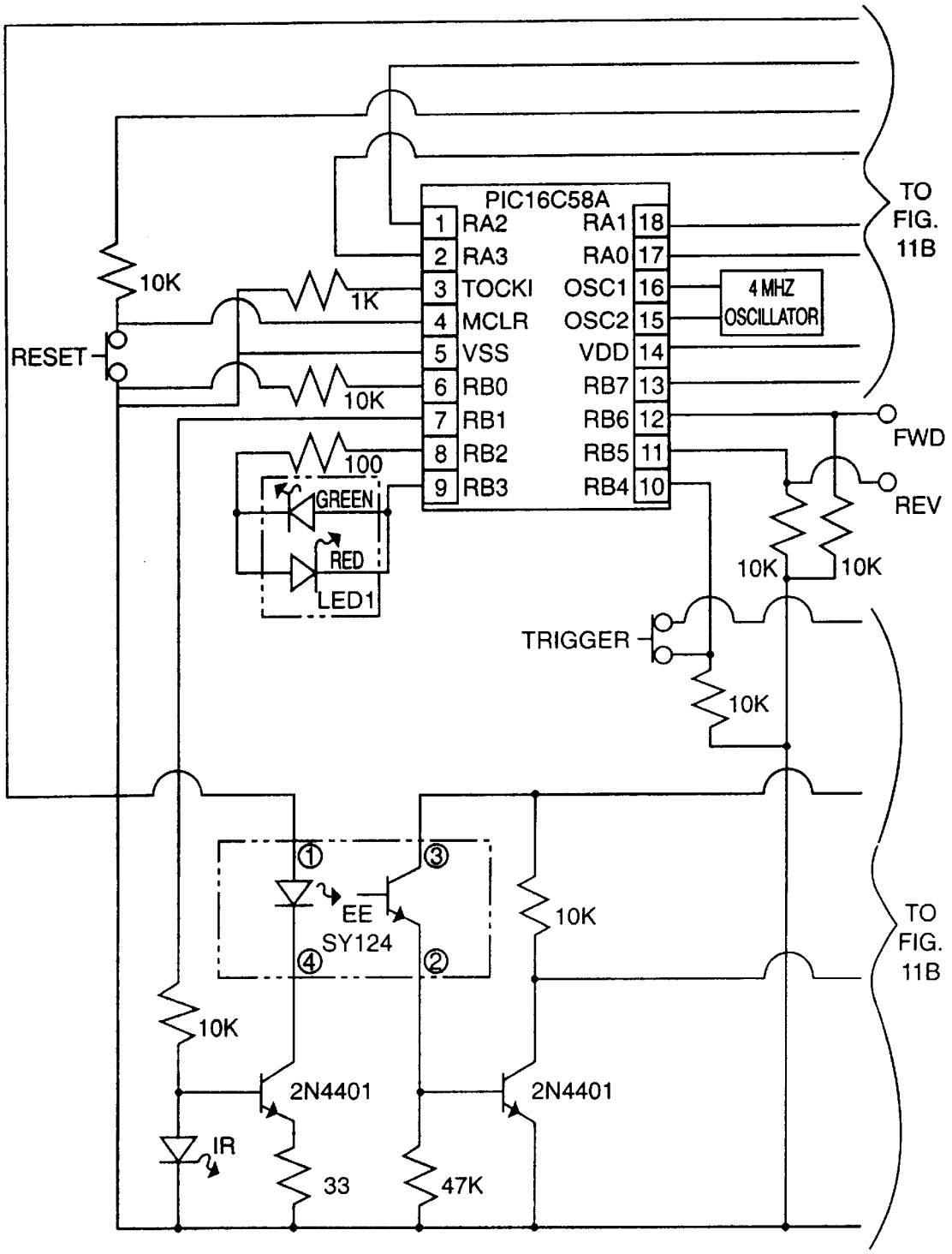
FIG. 11 schematically shows the electronic controls of the present invention.
Figure 11B:
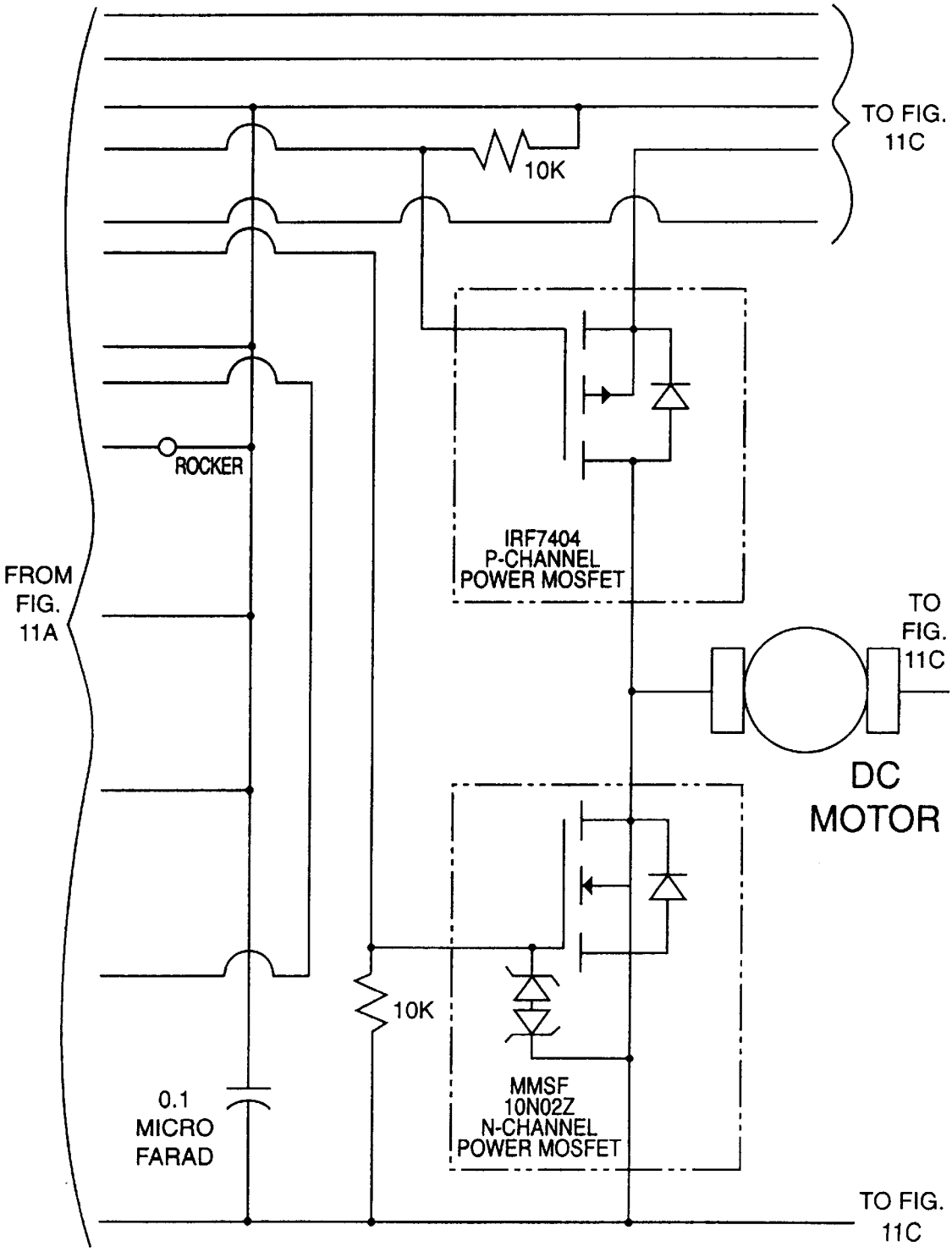
Figure 11C:
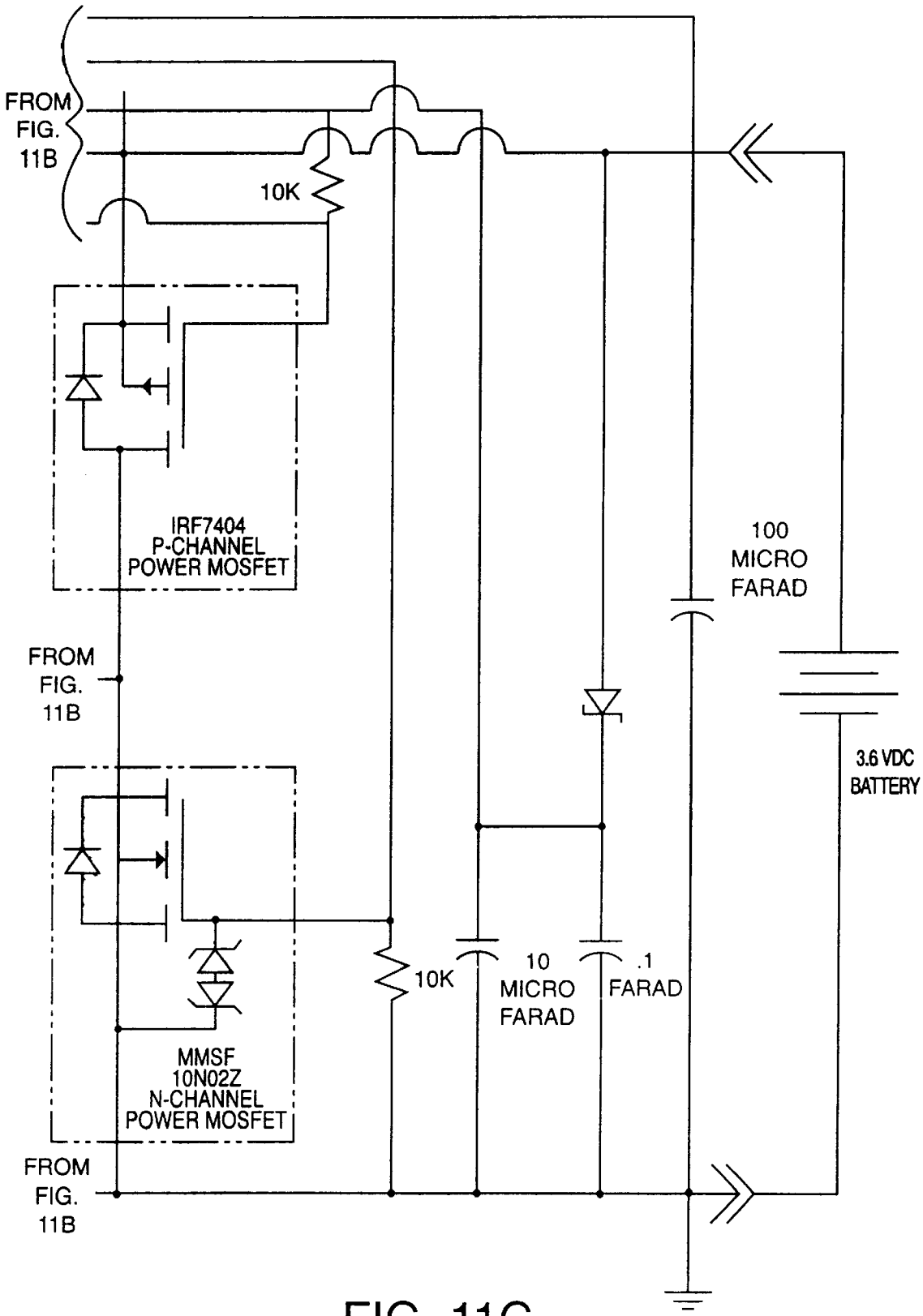
Figure 12A:
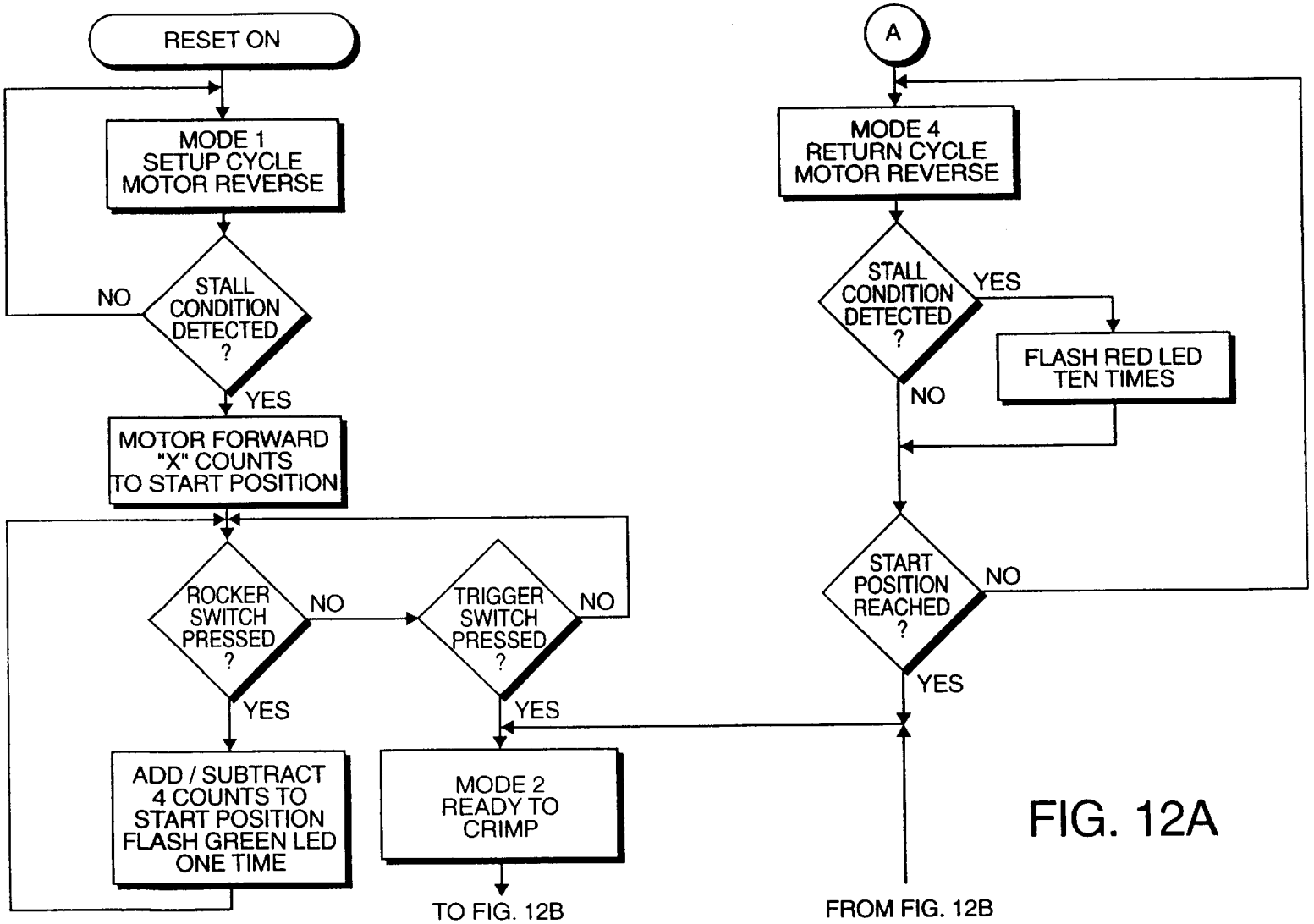
FIG. 12 is a computer flowchart for the powered crimper setup or adjustment and operation.
Figure 12B:
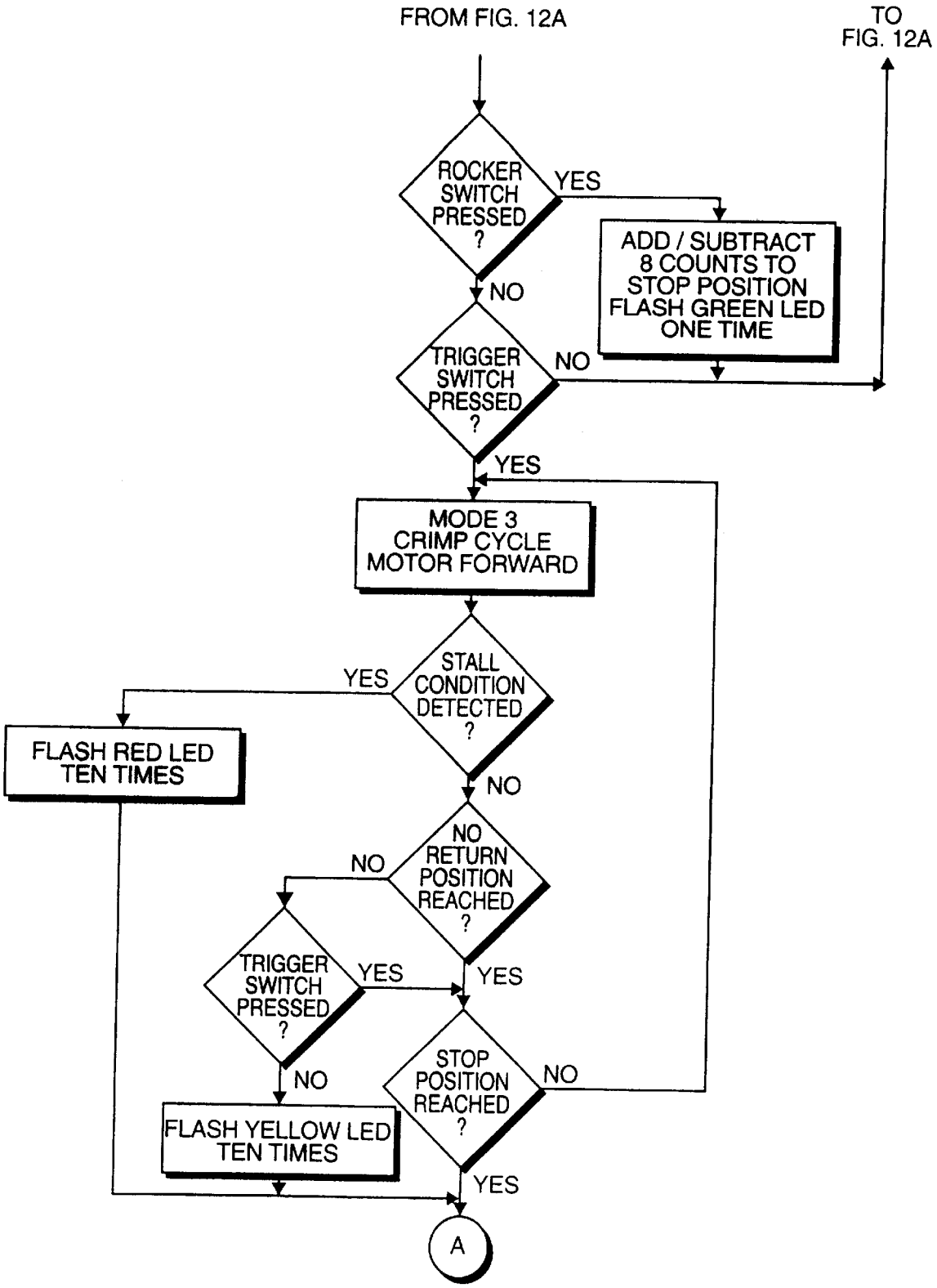
Figure 13:
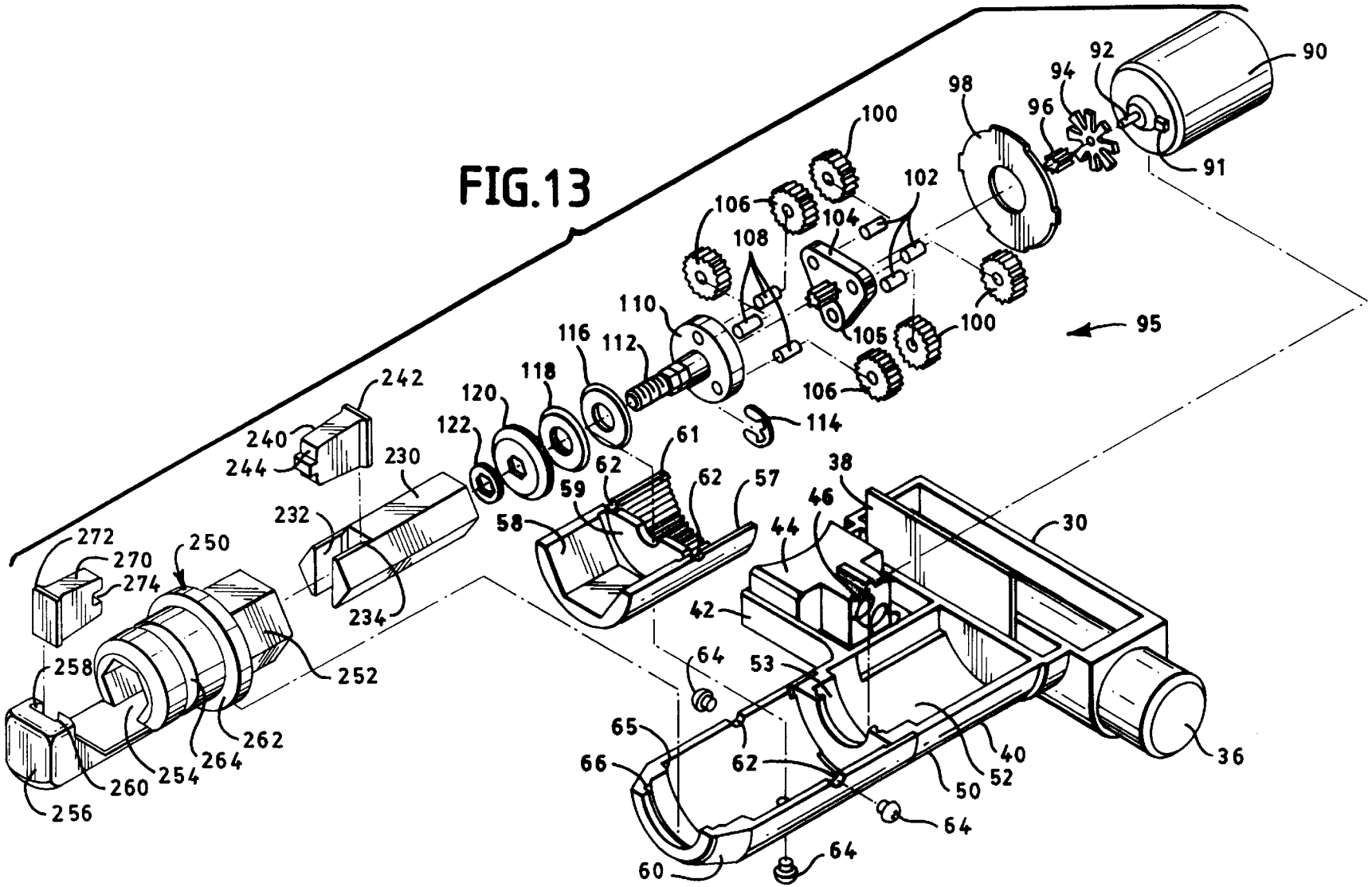
FIG. 13 shows an exploded view of the wire crimping tool with a portion of the housing and insert removed to show how the housing receives the various components.
Figure 14:
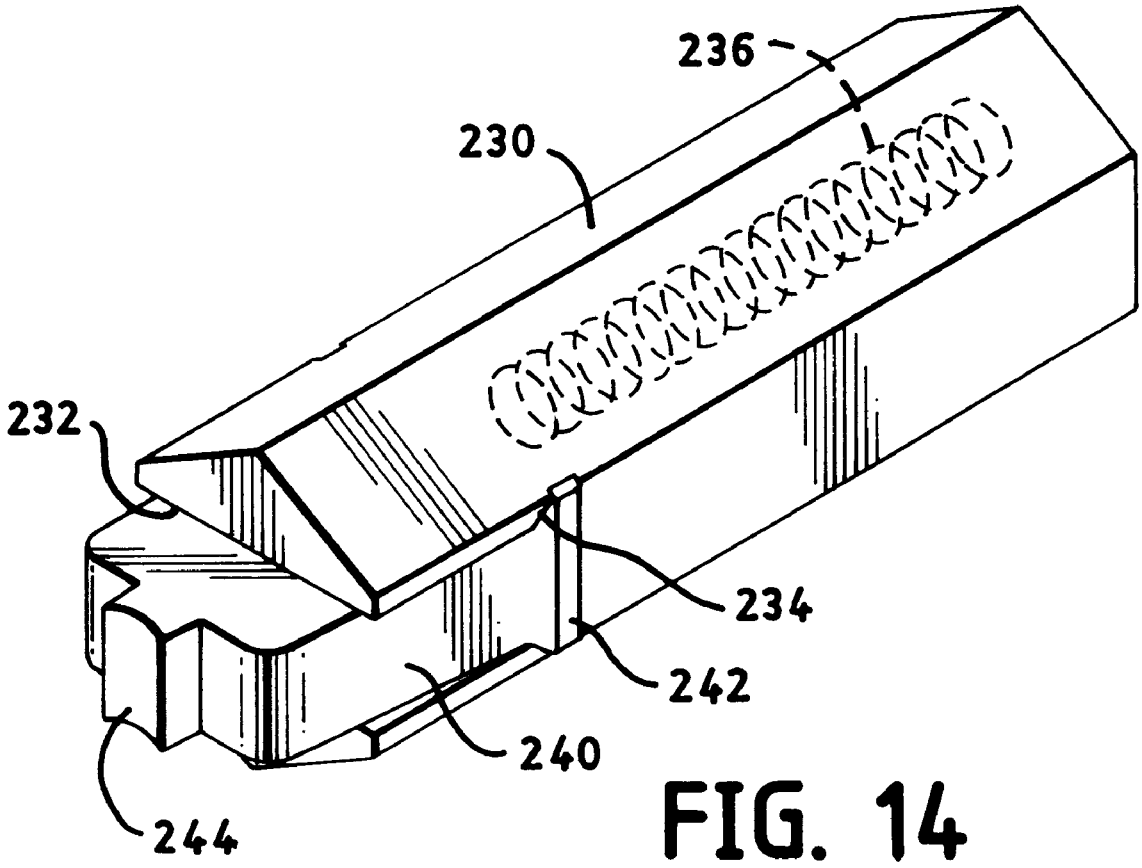
FIG. 14 is a perspective view of the hex shaped plunger of the wire crimping tool of FIG. 13, the plunger having a crimper head inserted therein.
Figure 15:
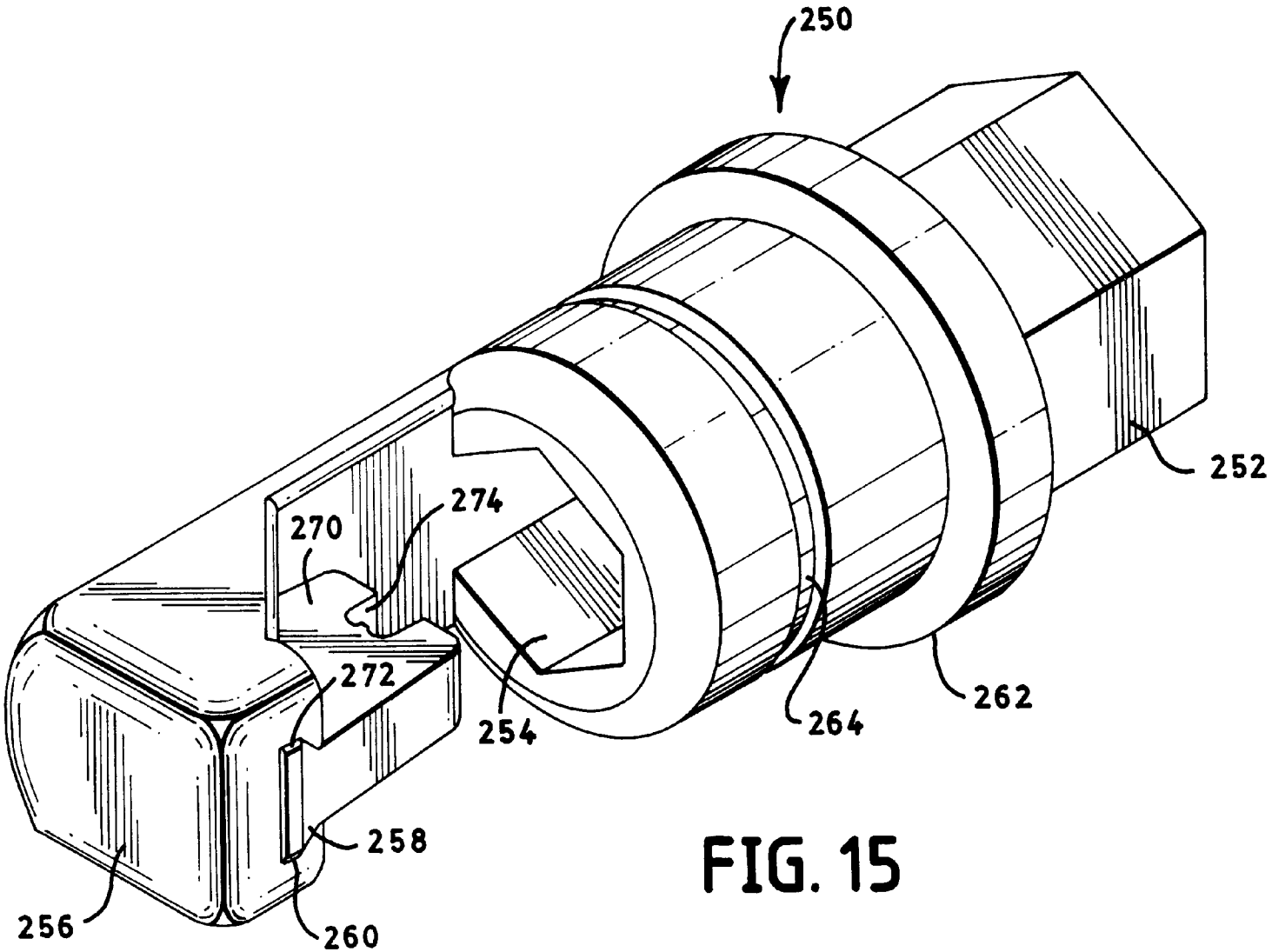
FIG. 15 is perspective view of the crimper housing of the wire crimping tool of FIG. 13, the crimper housing having a crimper head inserted therein.
Figure 16:
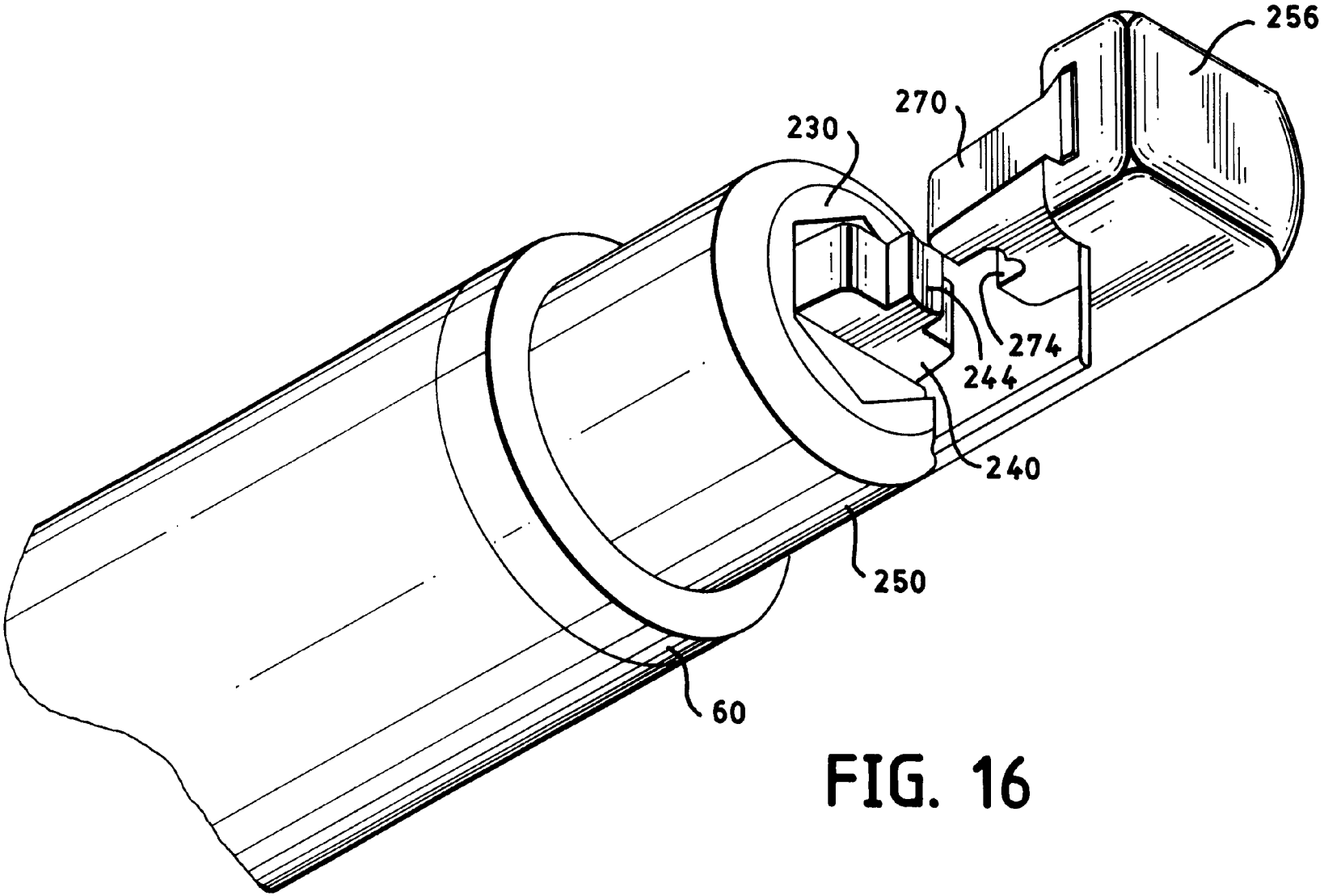
FIG. 16 is a perspective view showing the crimper housing received by a portion of the tool housing of the wire crimping tool of FIG. 13, the hex shaped plunger with crimper head being received by the crimper housing; and, FIG. 17 shows the assembled lower portion of the tool of FIGS. 13–16 in cross section.

FIGS. 10 and 11 show, in block diagram and schematic, the electronic controls for the tool 10, many of which are mounted on circuit board 38 or connected thereto. FIG. 12 shows a flowchart of how the computer program controls the setup and operation of the powered crimper. Battery or batteries 36 are shown providing power to motor 90 upon activation. When the battery or batteries have an insufficient charge remaining, the three-color LED 48 will be constantly illuminated in red. Pulse sensor 91 detects rotational movement of the motor 90 shaft. With motor 90 operating at 5760 rpm and the pulse disk identifying 8 pulses per motor shaft revolution, the starting and stopping points of the crimp cycle can be very accurately set, incrementally adjusted, and stored in memory. All of this is controlled by a Microchip Technologies PIC Micro Controller, model number PIC 16C58.

The tool 10 has a start-up mode and a crimp mode, which operate as shown by the flowchart of FIG. 12. The start-up mode is initiated by engaging a reset switch 49 or upon insertion of a charged battery into battery receiving channel 34 if the 0.1 Farad memory backup capacitor has discharged because of an extensive period without a connected or charged battery. First, the motor 90 reverses, moving the plunger 130 upward, until a stall condition is detected. A stall condition is detected when the motor rpm decreases and the time between pulses from disk 94 is about 10 times the normal operating time. Then, the motor 90 reverses direction and moves the plunger downward to a pre-set START position. In general, the motor will rotate until the pulse sensor has detected a pre-set number of pulses. Typically, this will move the plunger downward so that the jaws 70 are at their most open position, that is, where 80 is at the narrowest diameter portion of hour glass 134. The START or jaw open position can be adjusted by pressing the + or – on the rocker switch 47 to raise or lower the plunger. Each time the rocker switch 47 is pressed, the motor 90 rotates for a pre-set number of pulse counts and the LED will flash green one time. This can be any desired number, but is preferably 4 counts. Once the jaws 70 are set at the desired opening, the trigger 44 is pressed and released to disengage the start-up mode. Instead of using a rocker switch 47, separate up and down adjustment switches can be provided.

The tool 10 is now configured for the preset crimp cycle. That is, upon activation of the crimp cycle by pressing the trigger 44, the motor 90 will rotate until the pulse sensor has detected a pre-set number of pulses, thereby moving the piston from the START position to the STOP position. Then, the motor 90 will reverse and the piston will be returned to the START position. With the present embodiment, the piston moves through about 0.250 vertical inch between the START and STOP. The number of threads per inch of plunger drive shaft 112 and plunger threaded drive channel 131 affect how many pulses between START and STOP positions.

It is desirable that the operator not have to engage the trigger 44 for the entire crimp cycle. While it could be set so that a simple press and release of the trigger would cause the tool to go through a complete crimp cycle, a safety factor is desired. Therefore, the trigger 44 must be pressed and held until the motor 90 rotates for sensing of a pre-set number of pulses, for example, 640 pulses. If the pre-set number of pulses is not reached, the LED will flash yellow 10 times after the motor has reversed. Once this rotation has occurred, the "No RETURN" position has been reached and the crimp cycle will be completed even if the trigger is released, unless a stall condition is sensed. If a stall condition is sensed, by a time period between pulses which is about 10 times than the normal time period between pulses, before the plunger reaches the STOP position, the motor will automatically reverse and return the plunger to the START position and the LED 48 will flash red 10 times in 5 seconds or until the start of the next crimp cycle, if 2.5 less than 5 seconds, to notify the user that the crimp cycle was not completed.

In the crimp mode, the rocker switch 47 can be used to adjust the STOP position. By using the + or – on the rocker switch 47, the plunger STOP limit can be adjusted downward or upward. Each time the rocker switch 47 is pressed, the motor 90 rotates for a pre-set number of pulse counts. This can be any desired number, but is preferably 8 counts and the LED will flash green one time. Therefore, if the tool 10 user sees that a bottle or vial has not had the cap adequately crimped thereon, the rocker switch 47 can be adjusted so that the plunger 130 will move further downward for the STOP position and that vial or bottle re-crimped. If the user sees that a vial or bottle is having the cap crimped on too tightly, the rocker switch 47 can be adjusted so that the plunger will stop further upward for the STOP position so that future vials or bottles will not have the cap crimped on as tightly.

While the above-described means for electronically adjusting the stop position is the inventors' preferred embodiment, alternatives can be employed. For example, instead of using a controller which counts pulses to control the various positions, a limit switch could be employed. The motor would move the plunger one direction until a desired limit was reached and then the motor would be reversed and the plunger moved in the opposite direction. The limit switch limit could be altered to adjust the plunger downward limit.

With reference to FIGS. 13–17, the crimping tool is shown as a wire crimper, the tool 10 having its plunger 130 and jaw assemblies 70 replaced with a hex shaped plunger 230 and a crimper housing 250, each containing a crimper head 240, 270, respectively. The operation of the wire crimper is very similar to that of tool 10, in that the motor 90, powered shaft 92, pulse sensor 91, pulse disk 94, speed reduction system 95, and housing 20, including insert 57 all function as previously described.

Figure 17:
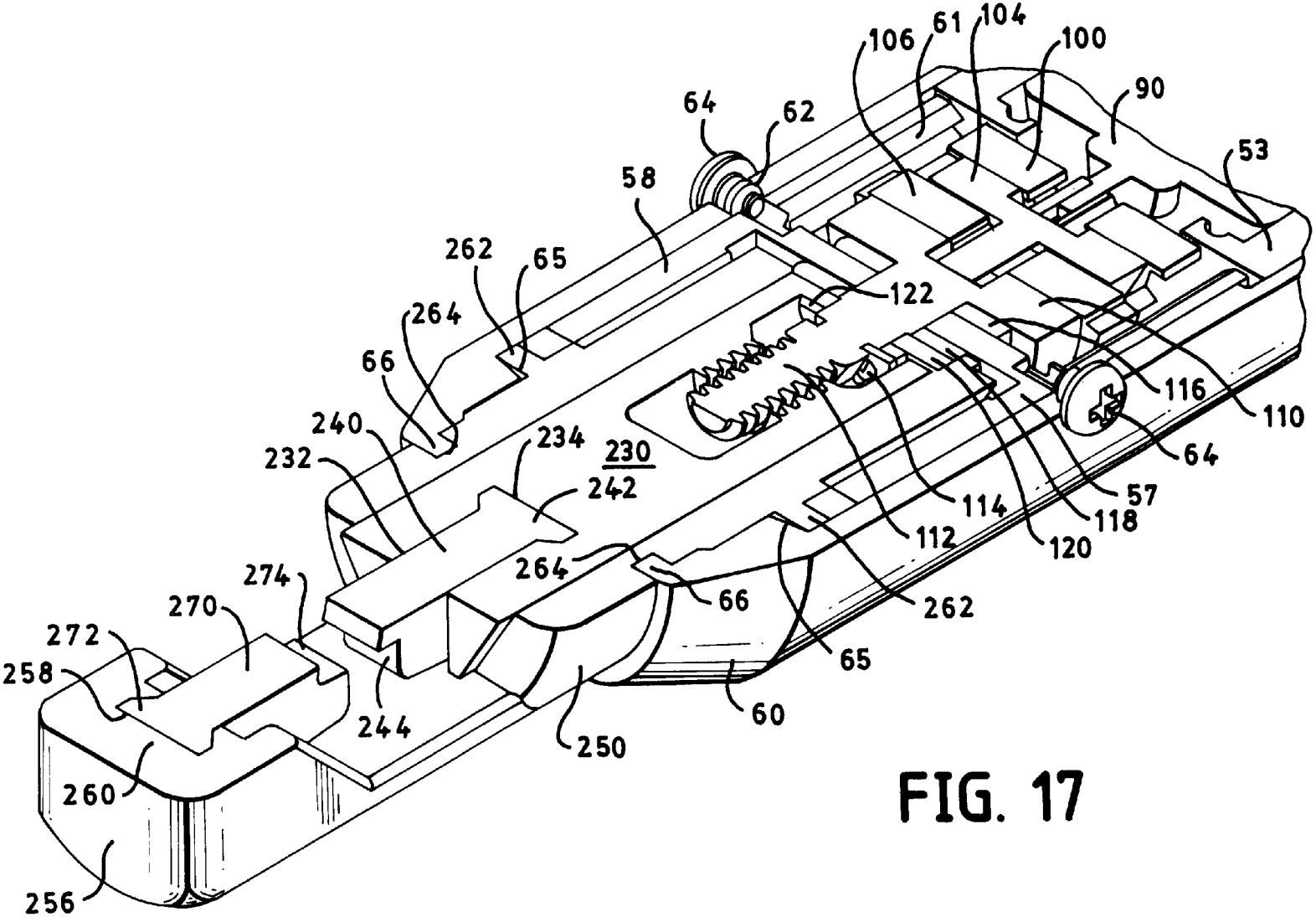

A crimper housing 250 includes a hex shaped area 252, which is received by hex plunger channel 58 of insert 57. As best seen in FIG. 17, a ring-shaped retainer 262 is received within lower portion 60 of housing 20 between ridge 65 and the lower end of channel 58 in insert 57 and a ring-shaped groove 264 into housing 250 receives ridge 66 of portion 60 of housing 20, so that crimper housing 250 is secured with respect to housing 20.

A plunger 230 has a hex shape and has an axial threaded bore 236 extending from the motor end. This bore 236 receives plunger threaded drive shaft 112 of plunger lead screw 110. Plunger 230 has a first crimper head opening 232 at its opposite end. Opening 232 has an enlarged rear portion 234 and is sized to receive first crimper head 240. First crimper head 240 includes an enlarged rear portion 242 and a crimping head face 244 and is sized to mate with opening 232 in plunger 230.

Plunger 230 is received by a hex shaped plunger receiving opening 254 in crimper housing 250. As the motor 90 is operated, plunger threaded drive shaft 112 rotates within crimper threaded bore 236 causing the plunger 230 to move to or from the motor 90 depending on the direction of rotation.

Crimper housing 250 contains a second crimper head receiving member 256 at its end opposite the hex shaped area 252 end. Member 256 includes a second crimper head opening 258 with an enlarged rear portion 260, sized to receive second crimper head 270 having an enlarged rear portion 272 and a crimping head face 274. Crimping head faces 244 and 274 of respective crimper heads 240 and 270 are cooperating faces to perform the desired crimping action. A plurality of pairs of crimper heads 240, 270 can be provided for the various types and sizes of terminals, splices, connectors, or the like to have a wire crimped therein.

While in the preferred embodiment of the wire crimper, second crimper head 270 is fixed with respect to the tool 10 and the first crimper head 240 is moved with respect thereto, either or both crimper heads could move.

In operation, to insert the desired crimper heads 240, 270, crimper head 240 should be inserted into opening 232 in plunger 230 before crimper head 270 is inserted into opening 258 in housing 250. This is accomplished by operating motor 90 to rotate screw 110 and move plunger 230 so that opening 232 is fully removed from opening 254. This then permits the insertion of the desired first crimper head 240. Then, motor 90 is reversed to draw plunger 230 and head 240 up into opening 254. Then, second crimper head 270 can be inserted into opening 258. The wire crimping tool is then ready for operation.

The desired operation is as follows. The motor 90 is operated to move the first crimper head 240 toward the second crimper head 270 until the terminal, or other item, to be crimped is "lightly" held by crimping head faces 244 and 274. With the item to be crimped supported by the tool, the operator can insert the desired wire into the item shaft. Then the tool can be reactivated to crimp the shaft having the wire inserted therein to make a secure crimped connection. Withdrawing face 244 from 274 permits removal of the crimped item and wire.

This desired operation of the wire crimper is effectuated by the following start-up procedure. After activation of the reset switch 49 or after complete power loss, the wire crimper 10 is in set-up mode and the movable crimper head 240 is advanced to nearly the pause position by operation of motor 90 and corresponding movement of plunger 230. In this set-up mode, the operator adjusts the pause position by using the rocker switch 47 (or separate up and down adjustment switches) to move the plunger 230 up or down. After this pause position has been set to "grab" the terminal lightly without crimping it, the operator puts the crimper in operating mode by pressing and releasing the activating button or trigger 44 one time. Alternatively, the set-up mode could be made slightly more complicated to allow adjustment both of the start position and the pause position. The final crimping position can be set in operating mode, as it is for the vial crimper of FIG. 1.

The operation/adjustment of the wire crimper can be similar to that of the crimping tool of FIG. 1. For example, the powered crimping tool can comprise a housing containing a motor therein, the housing having a trigger switch, at least one adjustment switch, and a reset switch. The housing can contain a circuit board having a controller operably connected thereto, with the trigger switch, the at least one adjustment switch, and the reset switch being operably connected to the controller. The motor includes a pulse disk on a motor powered shaft and where the tool includes a pulse sensor, the motor powered shaft being operably connected through a speed reduction system and a plunger lead screw to a plunger movable between a start position with a value of "x" counts and a stop position having a value of "y" counts, there being a pause position with a value of "z" counts, the pause position being intermediate of the start position and the stop position. By a first operation of the trigger switch and the motor thereby, the controller will cause the motor powered shaft to rotate until the pulse sensor has detected a first selected number of pulses with a value of "z−x" counts from the pulse disk to move the piston from the start to the pause position, unless a stall condition is detected. By a second operation of the trigger switch and the motor thereby, the controller will cause the motor powered shaft to rotate until the pulse sensor has detected a second selected number of pulses with a value of "y−z" counts from the pulse disk to move the piston from the pause to the stop position, unless the stall condition is detected. When the second selected number of pulses has been detected or the stall condition is detected, the motor powered shaft will rotate to return the piston to the start position. The tool also includes a first crimper and a second crimper, at least one of which is operably connected to the piston; the first and second crimpers being spaced a first distance when the plunger is at the start position, being spaced a second distance when the plunger is at the pause position, and spaced a third distance when the plunger is at the stop position, the first distance being greater than the second distance, the second distance being greater than the third distance. When the tool is in a reset mode, the at least one adjustment switch can be pressed to adjust the start position and the value of "x" counts. When the tool is in a crimp mode, the at least one adjustment switch can be pressed to adjust the stop position and the value of "y" counts.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. A powered crimping tool, comprising:

a. a housing containing a motor therein, said housing receiving a crimper housing, said crimper housing having an opening therein, said crimper housing having a lower crimper head receiving member having a lower crimper head opening therein;

b. a plunger received by said crimper housing opening, said plunger having an upper crimper head opening therein;

c. an upper crimper head received by said upper crimper head opening and a lower crimper head received by said lower crimper head opening;

d. said plunger being movable by said motor so as to move said upper crimper head toward said lower crimper head to crimp an item and to move said upper crimper head away from said lower crimper head to remove said item crimped.

2. The powered crimping tool of claim 1, where said tool has a crimper head start position where said upper and lower crimper heads are spaced a greatest distance apart, where said tool has a crimper head stop position where said upper and lower crimper heads are spaced a closest distance apart, and where said tool has a pause position where said upper and lower crimper heads are spaced an intermediate distance apart, said intermediate distance being greater than said closest distance and less than said greatest distance, said tool further comprising means for electronically adjusting at least one of said crimper head start, pause, and stop positions.

3. The powered crimping tool of claim 1, where said motor has a powered shaft extending therefrom, said powered shaft being connected to a speed reduction system, said speed reduction system being connected to a plunger threaded drive shaft; said plunger having a threaded bore therein receiving said plunger threaded drive; said housing containing an insert having a plunger channel receiving said plunger; where, when said motor is operated to cause said powered shaft to rotate in a first direction, said plunger threaded drive shaft rotates to cause said plunger to move in a crimping direction without rotation as permitted by a cooperation between said plunger channel and said plunger; and where, when said motor is operated to cause said powered shaft to rotate in a second direction opposite said first direction, said plunger threaded drive shaft rotates to cause said plunger to move away from said crimping direction without rotation as permitted by a cooperation between said plunger channel and said plunger.

4. The powered crimping tool of claim 3 where said plunger threaded drive shaft is received by an upper thrust bearing and a lower thrust bearing, said thrust bearings reducing tool torque requirements.

5. The powered crimping tool of claim 1, where said motor is operable by activation of an internal direct current power source.

6. The powered crimping tool of claim 1, where said motor is operable by an external power source.

7. The powered crimping tool of claim 1, where said housing includes a lower housing portion which will be held by a tool operator and, when said tool is so held, said crimper housing extends from said housing extend in a vertically downward direction.

8. The powered crimping tool of claim 1, further comprising: means for activating said motor.

9. The powered crimping tool of claim 8, where said activating means must be engaged for a pre-set interval during which said plunger moves from a crimper head start position to an intermediate no return position and where, thereafter said plunger will move on to a crimper head stop position and then to said crimper head start position irrespective of said condition of said activating means.

10. The powered crimping tool of claim 2, where said motor includes a pulse disk on a motor powered shaft and where said tool includes a pulse sensor; where said motor powered shaft will rotate until said pulse sensor has detected a selected number of pulses from said pulse disk to move said piston from said crimper head start position to said crimper head stop position; and where said means for electronically adjusting at least one of said crimper head start, pause, and stop positions causes said selected number of pulses to be numerically changed.

11. The powered crimping tool of claim 2, where said means for electronically adjusting at least one of said crimper head start, pause, and stop positions includes at least means for electronically adjusting said start position and means for electronically adjusting said stop position; where said motor includes a pulse disk on a motor powered shaft and where said tool includes a pulse sensor; where said motor powered shaft will rotate until said pulse sensor has detected a selected number of pulses from said pulse disk to move said piston from said start to said stop position; where said means for electronically adjusting said stop position causes said selected number of pulses to be numerically changed; and where said means for electronically adjusting said start position causes said motor powered shaft to rotate until said pulse sensor has detected a pre-set number of pulses from said pulse disk.

12. The powered crimping tool of claim 11, said motor powered shaft being connected to a speed reduction system, said speed reduction system being connected to a plunger threaded drive shaft; said plunger having a threaded drive channel receiving said plunger threaded drive shaft, said plunger having a guide member toward an upper end; said housing containing an insert having a plunger channel receiving said plunger guide member; where, when said motor is operated to cause said powered shaft to rotate in a first direction, said plunger threaded drive shaft rotates to cause said plunger to move in a crimping direction without rotation as permitted by a cooperation between said plunger channel and said plunger guide member; and where, when said motor is operated to cause said powered shaft to rotate in a second direction opposite said first direction, said plunger threaded drive shaft rotates to cause said plunger to move away from said crimping direction without rotation as permitted by a cooperation between said plunger channel and said plunger guide member.

13. The powered crimping tool of claim 12, further comprising: means for activating said motor.

14. The powered crimping tool of claim 13, where said activating means must be engaged for a pre-set interval during which said plunger moves from said start position to an intermediate no return position and where, thereafter said plunger will move on to said stop position and then to said start position irrespective of said condition of said activating means.

15. The powered crimping tool of claim 14, where said housing includes a lower housing portion which will be held by a tool operator.

16. A powered crimping tool, comprising: a housing containing a motor therein, said housing having a trigger switch, at least one adjustment switch, and a reset switch;

said housing containing a circuit board having a controller operably connected thereto, said trigger switch, said at least one adjustment switch, and said reset switch being operably connected to said controller;

said motor includes a pulse disk on a motor powered shaft and where said tool includes a pulse sensor, said motor powered shaft being operably connected through a speed reduction system and a plunger lead screw to a plunger movable between a start position with a value of "x" counts and a stop position having a value of "y" counts, there being a pause position with a value of "z" counts, said pause position being intermediate of said start position and said stop position;

where, by a first operation of said trigger switch and said motor thereby, said controller will cause said motor powered shaft to rotate until said pulse sensor has detected a first selected number of pulses with a value of "z−x" counts from said pulse disk to move said piston from said start to said pause position, unless a stall condition is detected, where, by a second operation of said trigger switch and said motor thereby, said controller will cause said motor powered shaft to rotate until said pulse sensor has detected a second selected number of pulses with a value of "y−z" counts from said pulse disk to move said piston from said pause to said stop position, unless said stall condition is detected, and when said second selected number of pulses has been detected or said stall condition is detected, said motor powered shaft will rotate to return said piston to said start position;

a first crimper and a second crimper, at least one of said first crimper and said second crimper operably connected to said piston; said first and second crimpers being spaced a first distance when said plunger is at said start position, being spaced a second distance when said plunger is at said pause position, and spaced a third distance when said plunger is at said stop position, said first distance being greater than said second distance, said second distance being greater than said third distance;

where, when said tool is in a reset mode, said at least one adjustment switch can be pressed to adjust said start position and said value of "x" counts; and, where, when said tool is in a crimp mode, said at least one adjustment switch can be pressed to adjust said stop position and said value of "y" counts.

17. A powered crimping tool, comprising:

a. a housing containing a motor therein, said motor being operably connected to a plunger movable between a start position and a stop position;

b. a first crimper and a second crimper, at least one of said first crimper and said second crimper operably connected to said piston; said first and second crimpers being spaced a first distance when said plunger is at said start position and being spaced a second distance when said plunger is at said stop position, said first distance being greater than said second distance;

c. said plunger being movable by said motor to crimp an item and to remove said item crimped.

* * * * *